US006742818B2

(12) United States Patent
Seki et al.

(10) Patent No.: US 6,742,818 B2
(45) Date of Patent: Jun. 1, 2004

(54) BOX LOCK WITH SAFETY DEVICE

(75) Inventors: Yoshiyuki Seki, Aichi (JP); Masakazu Fukuta, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/896,565

(22) Filed: Jun. 29, 2001

(65) Prior Publication Data

US 2002/0000728 A1 Jan. 3, 2002

(30) Foreign Application Priority Data

Jun. 30, 2000 (JP) ..... 2000-198178

(51) Int. Cl.[7] ..... E05C 3/16

(52) U.S. Cl. ..... 292/216; 292/217; 292/DIG. 42; 292/DIG. 65; 70/DIG. 62

(58) Field of Search ..... 292/DIG. 42, DIG. 65, 292/216, 217; 70/DIG. 62

(56) References Cited

U.S. PATENT DOCUMENTS 3,824,817 A * 7/1974 Orr ..... 292/147
3,992,909 A * 11/1976 McGhee ..... 292/336.3
4,155,233 A * 5/1979 Lira ..... 292/111
4,438,964 A * 3/1984 Peters ..... 292/173
4,962,955 A * 10/1990 Ferrara et al. ..... 292/199
5,069,491 A * 12/1991 Weinerman et al. ..... 292/216
5,129,694 A * 7/1992 Tanimoto et al. ..... 29/437
5,152,161 A * 10/1992 Lee ..... 292/212
5,445,326 A * 8/1995 Ferro et al. ..... 292/203
5,642,636 A * 7/1997 Mitsui ..... 292/201
5,894,749 A * 4/1999 Tomaszewski et al. ..... 292/DIG. 43
6,024,388 A * 2/2000 Tomah et al. ..... 292/216
6,135,514 A * 10/2000 Kowalewski et al. ..... 292/216

FOREIGN PATENT DOCUMENTS

CH 676730 A * 2/1991 ..... E05B/15/14
DE 19613865 A1 * 10/1997 ..... E05B/15/10

* cited by examiner

*Primary Examiner*—J. J. Swann
*Assistant Examiner*—Thomas Ho
(74) *Attorney, Agent, or Firm*—Patterson, Thuente, Skaar & Christensen, P.A.

(57) ABSTRACT

A lock for a lid that opens and closes a box. The lock includes a latch. The latch engages a catch to prevent the lid from opening when the lid is closed. A crank moves between a locking position and an unlocking position. The crank engages the latch at the locking position and is disengaged from the latch at the unlocking position. A handle is used to open the lid from an outer side of the box. The handle moves the crank from the locking position to the unlocking position. A lever is used to open the lid from an inner side the box. The lever moves the holding member from the locking position to the unlocking position. A key-operated mechanism shifts the crank between an operational position, at which the handle works, and a non-operational position, at which the handle cannot work.

3 Claims, 11 Drawing Sheets

BOX LOCK WITH SAFETY DEVICE

BACKGROUND OF THE INVENTION

The present invention relates to a lock for lids, and more particularly, to a lock for lids of vehicle storage boxes.

Since consumers use automobiles for various purposes, many types of automobiles are manufactured. For example, there are vehicles that have a storage box arranged in the rear portion of the vehicle. Such storage box is large enough for a person to get in. A lid is attached to the top or lateral side of the box. The lid includes a lock and has a knob that is manipulated from the outer side of the box. When the storage box is closed, the knob is manipulated from the outer side of the box to open the box.

However, the knob cannot be operated from the inner side of the box. Thus, if a person gets locked in the storage box, the person must have someone else unlock the lid.

SUMMARY OF THE INVENTION

It is an object of the present invention to provide a storage box lock that is easily operated and unlocked from both inner and outer sides of the box.

To achieve the above object, the present invention provides a lock for a lid that opens and closes a box. One of the box and the lid is a first part and the other is a second part. The lock includes a latch provided on the first part. The latch engages a catch, which is on the second part, to prevent the lid from opening when the lid is closed. A holding member moves between a locking position and an unlocking position. The holding member engages the latch at the locking position and is disengaged from the latch at the unlocking position. A first manipulator opens the lid from an outer side of the box when the lid is closed. The first manipulator moves the holding member from the locking position to the unlocking position. A second manipulator opens the lid from an inner side of the box when the lid is closed. The second manipulator moves the holding member from the locking position to the unlocking position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 15 is a partial cross-sectional perspective view showing the lock;

FIG. 16 is a plan view showing a clearance of the lock;

FIG. 17 is a schematic explanatory view showing a crank located at an operational position;

FIG. 18 is a schematic explanatory view showing the crank separated from a latch when the crank is located at the operational position;

FIG. 19 is a schematic explanatory view showing the crank located at a non-operational position; and FIG. 20 is a schematic explanatory view showing the crank separated from the latch when the crank is located at the non-operational position.

DETAILED DESCRIPTION OF THE PREFERRED EMBODIMENTS

A first embodiment according to the present invention will now be described with reference to FIGS. 1 to 14.

Figure 5:
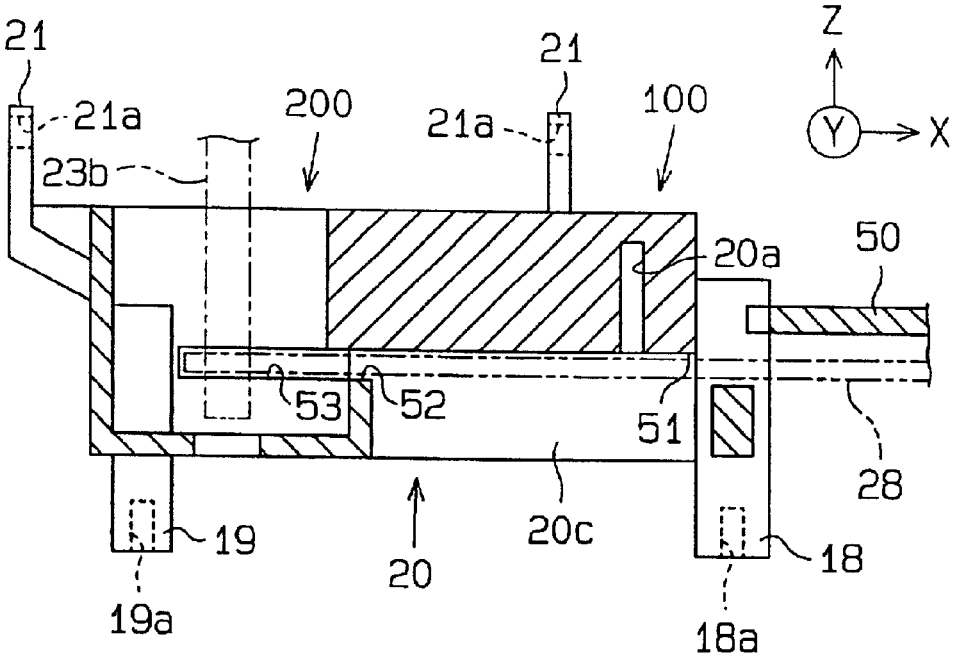
FIG. 5 is a partial cross-sectional view taken along line 5—5 in FIG. 3.
Figure 6:
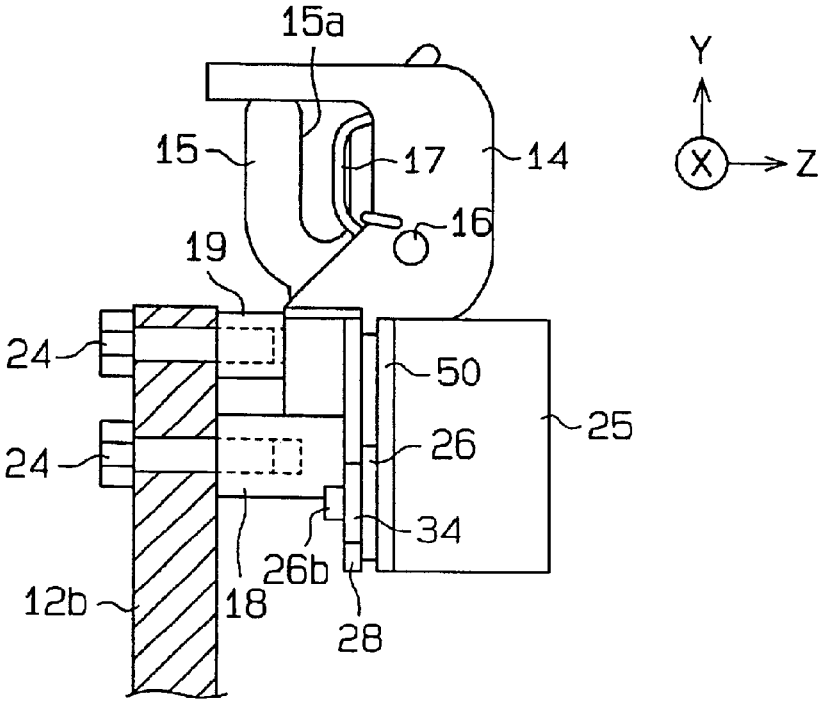
FIG. 6 is an explanatory view showing the relationship between the lock and a lid.

In this embodiment, the right direction and the upward direction as viewed in FIG. 5 are respectively referred to as the X axis direction and the Z axis direction, and the upward direction as viewed in FIG. 6 is referred to as the Y axis direction. The X, Y, and Z axes are perpendicular to one another.

Figure 1:
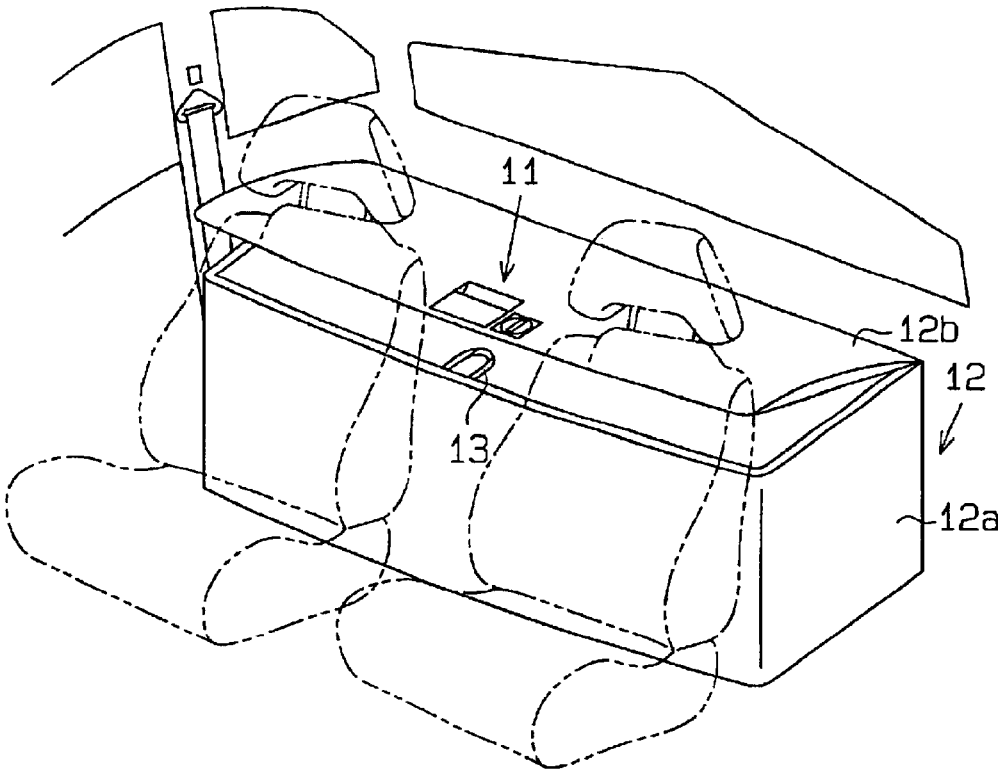
FIG. 1 is a schematic view showing the interior of an automobile having a storage box that employs a lock according to the present invention.

FIG. 1 shows a storage box 12 arranged in the rear portion of an automobile. The storage box 12 includes a lock 11 and is formed from a box body 12*a*, one of the sides of which is opened, and a lid 12*b*. The lid 12*b* is supported so that it opens and closes the body 12*a*.

Figure 3:
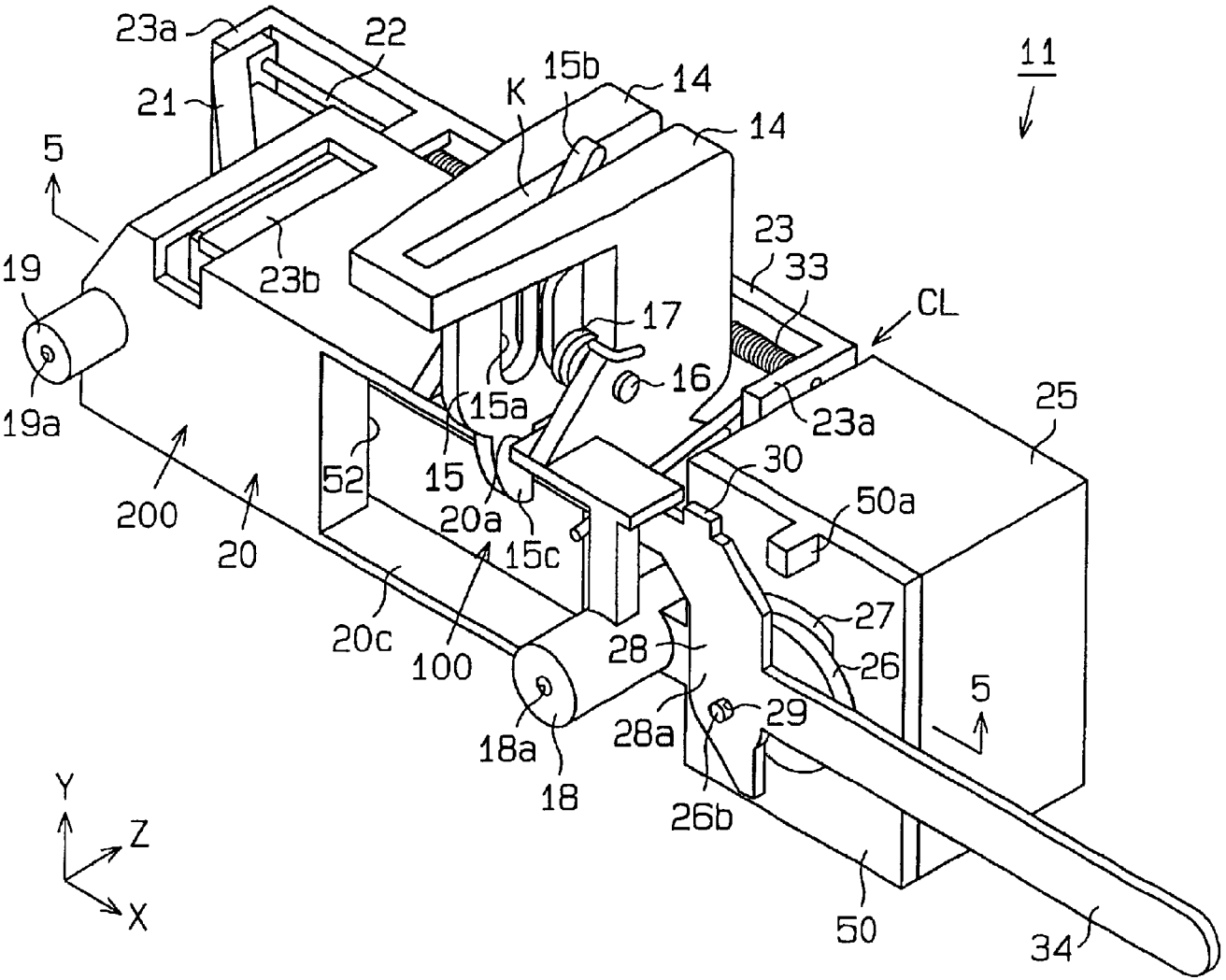
FIG. 3 is an enlarged perspective view showing the lock from an opposite side of FIG. 2.

The lock 11 is arranged in the lid 12*b*. A catch 13 is located near the opening of the body 12*a*. When the lid 12*b* is closed, the lock 11 engages the catch 13. Referring to FIG. 3, the lock 11 has a frame 20. As shown in FIG. 5, the frame 20 has a first frame portion 100 and a second frame portion 200.

Bosses 18, 19 respectively extend through the first frame portion 100 and the second frame portion 100. The bosses 18, 19 respectively have threaded holes 18*a*, 19*a*. Referring to FIG. 6, a pair of bolts 24 are inserted in the threaded holds 18*a*, 19*a* to connect the lid 12*b* to the frame 20.

Figure 8:
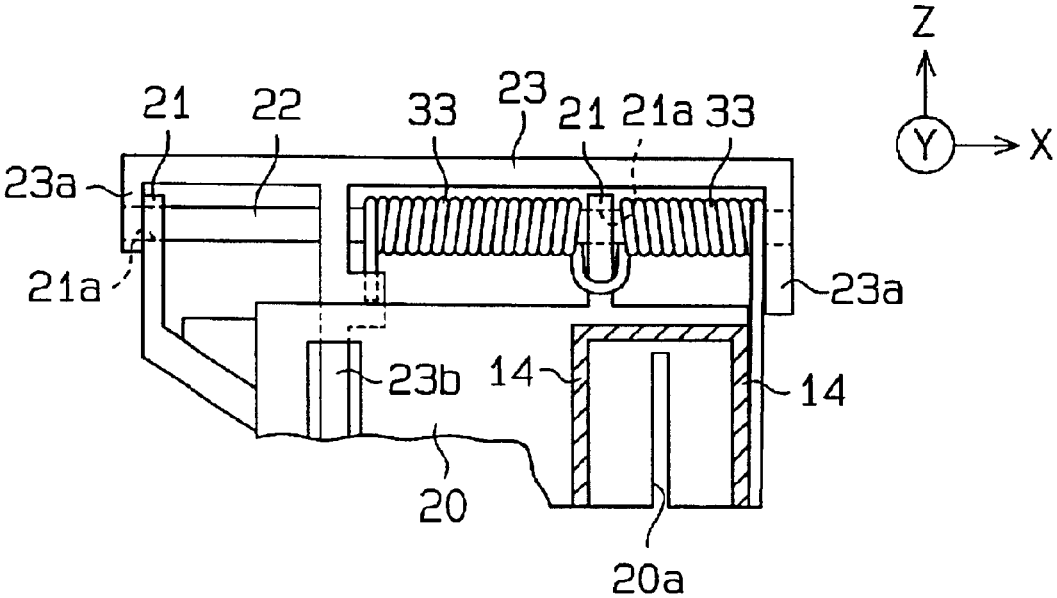
FIG. 8 is a partial cross-sectional view showing lever.

As shown in FIG. 3, the first frame portion 100 has an L-shaped bracket 14 extending in the Y axis direction. A slot K extends through the middle of the bracket 14 in the Y and Z axes directions. Further, as shown in FIG. 8, a slit 20*a* extends through a wall of the frame 20, which is located on the Y axis side, in the Z axis direction at a position corresponding to the slot K.

A pin 16, which extends transversely to the slot K, is fixed to the basal end of the bracket 14. The pin 16 pivotally supports the latch 15 so that the latch 15 moves in the slit 20*a* and the slot K. An engaging plate 15*c* projects from the latch 15 in the negative Y axis direction.

An engaging wall 20*b* (FIG. 9) is formed in the first frame portion 100 at a location corresponding to the basal end of the bracket 14. The engaging plate 15*c* of the latch 15 engages the engaging wall 20*b* (FIG. 10). When the engaging plate 15*c* is engaged with the engaging wall 20*b* as shown in the state of FIG. 10, the latch 15 is located at an unlock position. Further, when the engaging plate 15*c* of the latch 15 is engaged with an elongated portion 28*b*, which will be described later, as shown in the state of FIG. 9, the latch 15 is located at a lock position.

A coil spring 17 is arranged on the pin 16. The two ends of the coil spring 17 are engaged with the bracket 14 and the middle portion of the coil spring 17 is engaged with the latch 15. This urges the latch 15 about the pin 16 in an releasing direction a (the counterclockwise direction as viewed in FIG. 9).

Figure 9:
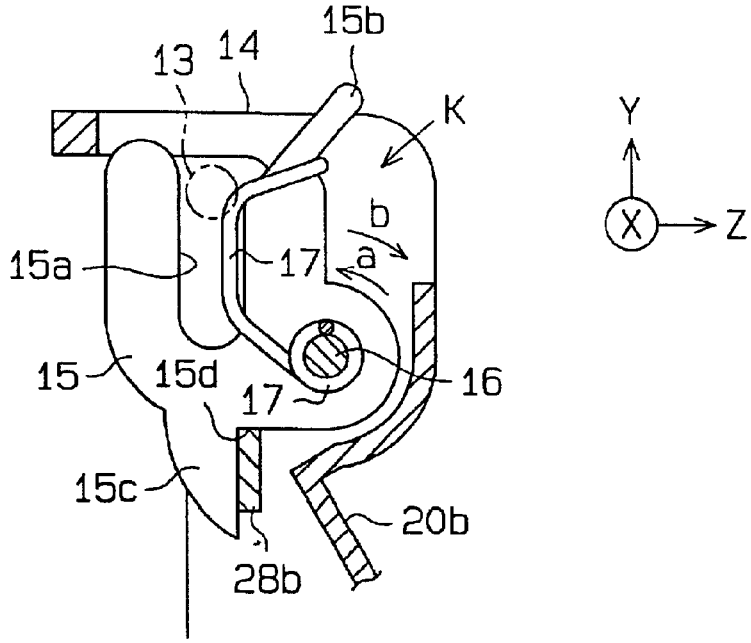
FIG. 9 is a partial cross-sectional view showing a latch in a lock position.
Figure 10:
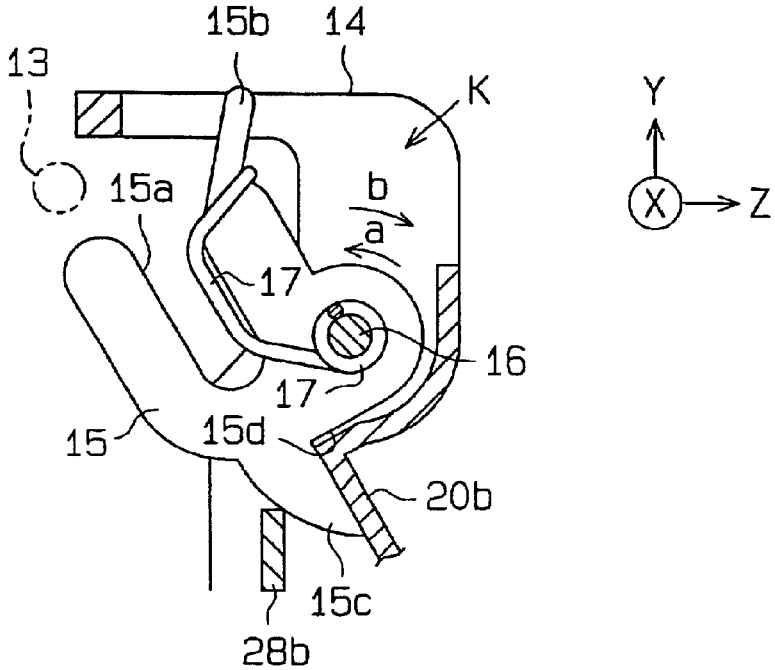
FIG. 10 is a partial cross-sectional view showing the latch in an unlock position.

An engaging slot 15*a* extends through the middle of the latch 15 in the positive Y axis direction as viewed in FIG. 9. When the latch 15 is located at the lock position as shown in the state of FIG. 9, the catch 13 is received in the engaging slot 15*a*.

When the latch 15 is located at the lock position, a distal portion of a hook 15*b* projects from the slot K. When the latch 15 is located at the unlock position, the hook 15*b* is oriented in the generally Y axis direction and is substantially retracted in the slot K.

When the lid 12*b* is closed, the catch 13 pushes the hook 15*b* and pivots the latch 15 about the pin 16 in a catching direction b (clockwise direction as viewed in FIG. 10).

Referring to FIG. 3, the first frame portion 100 has an engaging wall 20*c* extending from the second frame portion 200. Referring to FIGS. 5 and 8, an extension plate 21 extends from each of the first and second frame portions 100, 200. The extension plates 21 each have a hole 21*a*. A shaft 22 is pivotally inserted through the holes 21*a* of the extension plates 21.

Figure 2:
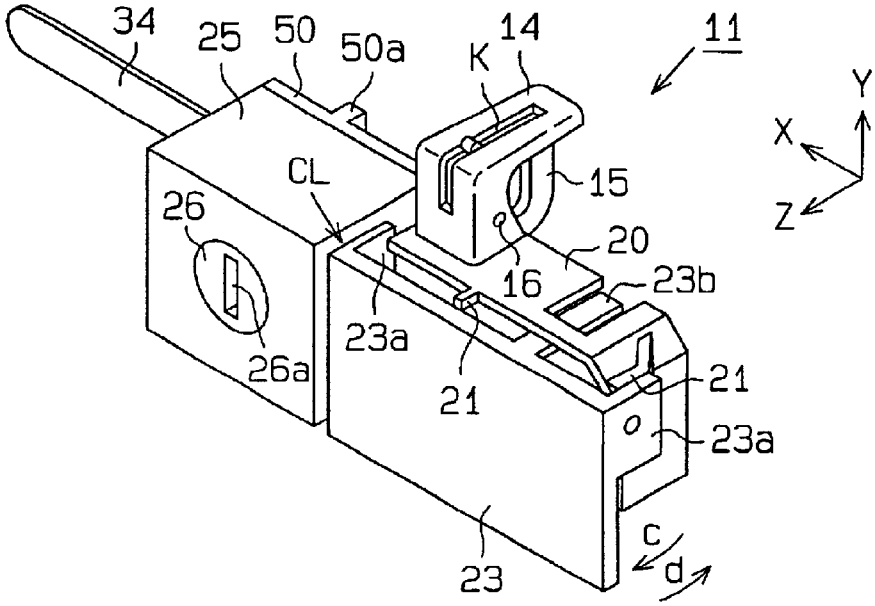
FIG. 2 is a schematic perspective view showing a lock according to a first embodiment of the present invention.

A handle 23, which functions as a first manipulator, having a pair of connecting plates 23*a* is integrally fixed to the ends of the shaft 22 by the connecting plates 23*a*. The handle 23 and the shaft 22 pivot relative to the extension plates 21. With reference to FIG. 2, the handle 23 pivots in an opening direction c to open the lid 12*b*. The handle 23 also pivots in a returning direction d, which is opposite the opening direction c, to return the handle 23 to its original position.

As shown in FIG. 5, a pushing plate 23*b* extends through the frame 20 from the middle of the handle 23. The pushing plate 23*b* is inserted through an opening in the second frame portion 200. The pushing plate 23*b* abuts the wall of the second frame portion 200 when the handle 23 is pivoted in the returning direction d. This holds the handle 23 at a home position.

An attachment plate 50 is formed integrally with the basal end of the boss 18. A key lock case 25 is attached to the attachment plate 50. A clearance CL extends between the key lock case 25 and the handle 23.

Figure 7A:
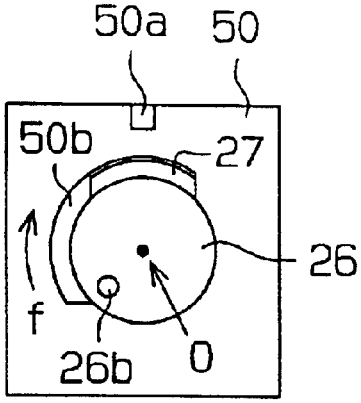
FIG. 7(*a*) is a plan view showing a connecting rod of a rotor located at an unlocking position, and FIG. 7(*b*) is a plan view showing the connecting rod of the rotor located at a locking position.
Figure 7B:
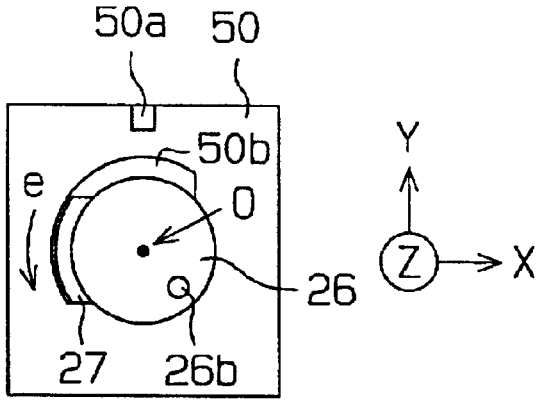

A key lock mechanism, which is known in the art, is arranged in the key lock case 25. A rotor 26, which forms part of the key lock mechanism, is connected to the key lock case 25. As shown in FIGS. 7(*a*) and 7(*b*), the attachment plate 50 has an arcuate recess 50*b*. The arcuate recess 50*b* extends about an axis O of the rotor 26 for a predetermined angular range. A rotation restriction plate 27, which functions as a restricting member, is arranged on the rotor 26 and received in the recess 50*b*. When the rotor 26 is rotated, contact between the rotor 26 and the end walls of the recess 50*b* restricts the rotation of the rotor 26 between a lock position and an unlock position. The state of FIG. 7(*a*) shows the rotor 26 located at the unlock position, and the state of FIG. 7(*b*) shows the rotor 26 located at the lock position.

The rotor 26 has a keyhole 26*a*. When a key is inserted in the keyhole 26*a* and rotated in a locking direction e, the rotor 26 is rotated in the counterclockwise direction about the axis O. After rotating the rotor 26 and removing the key, the rotor 26 does not rotate further and is held at the lock position. When the key is inserted in the keyhole 26*a* and rotated in an unlocking direction f, the rotor 26 is rotated in the counterclockwise direction as viewed in FIG. 7(*a*). This rotates the rotor 26 to the unlock position and unlocks the lock.

The surface of the rotor 26 is flush with the surface of the key lock case 25. A stopper 50*a* projects from the upper middle portion of the attachment plate 50. Further, a connecting rod 26*b* projects from the rotor 26 at a position offset from the axis O. The connecting rod 26*b* is inserted through a hole 29 of a generally L-shaped crank 28, which is also referred to herein as a holding member. The crank 28 has a short portion 28*a*, which extends in the Y axis direction, and an elongated portion 28*b*, which extends in the X axis direction.

An abutment plate 30 projects in the Y axis direction from the basal portion of the elongated portion 28*b*. The abutment plate 30 abuts against the stopper 50*a*. As viewed in FIG. 5, the elongated portion 28*b* is inserted into the second frame portion 100 through an opening 51, which is defined in the first frame portion 100, and a guide space 52, which is defined between walls in the first and second frame portions 100, 200. The guide space 52 extends to the engaging wall 20*c*.

Figure 11:
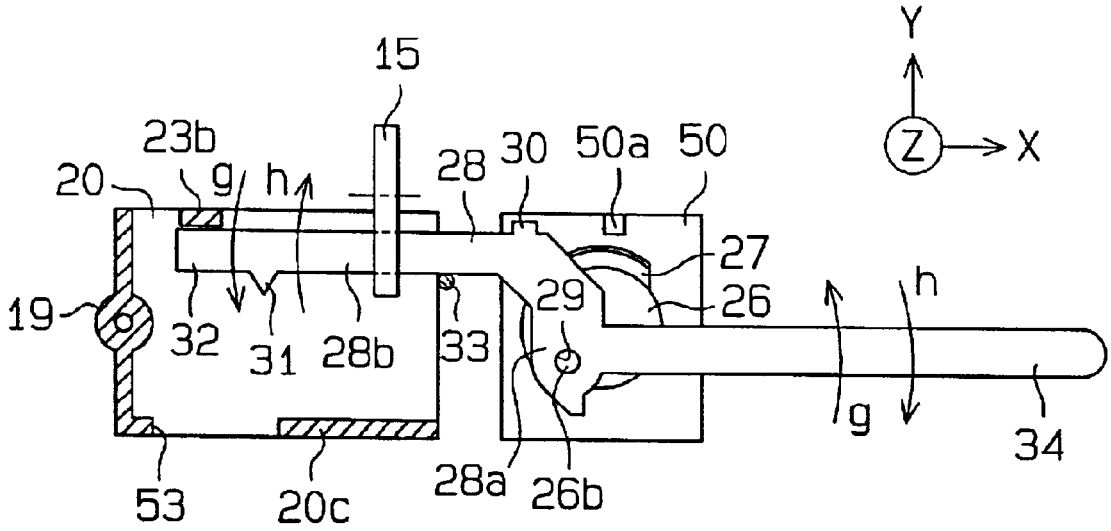
FIG. 11 is a schematic explanatory view showing a crank located at an operational position.
Figure 12:
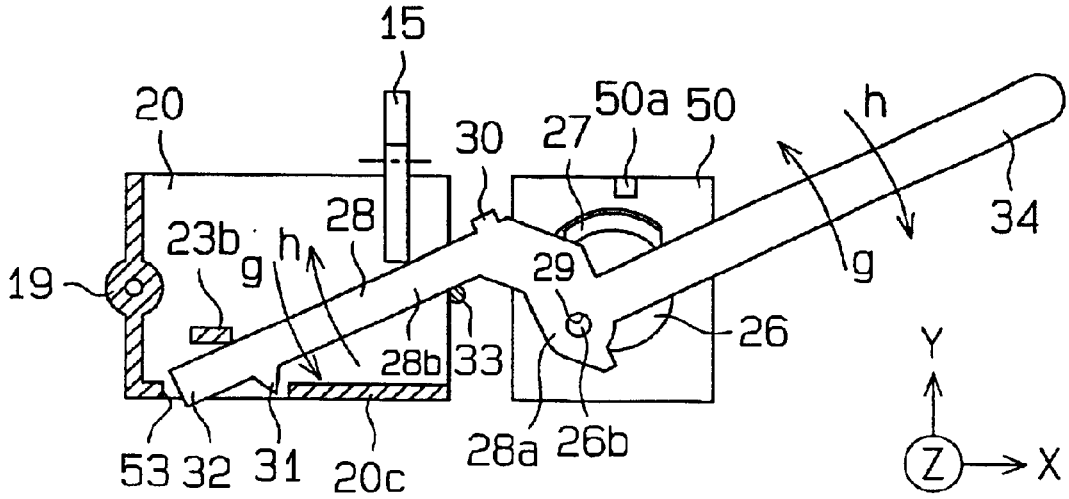
FIG. 12 is a schematic explanatory view showing the crank separated from the latch when the crank is located at the operational position.

An engaging projection 31 extends from the distal portion of the elongated portion 28*b* in the negative Y axis direction. When the crank 28 is rotated in a releasing direction g, the engaging projection 31 contacts the engaging wall 20*c* (FIG. 12). This restricts the rotation of the crank 28. The distal end of the elongated portion 28*b* functions as a pushed portion 32. Referring to FIG. 11, the pushed portion 32 is pushed by the pushing plate 23*b* of the handle 23 when the rotor 26 is located at the unlock position. In this state, the crank 28 is located at an operational position.

When the crank 28 is located at the operational position, as viewed in FIG. 11, the crank 28 may be moved in the releasing direction g away from the latch 15. In this case, the engaging projection 31 of the crank 28 is received in an engaging groove 53 of the second frame portion 200 as shown in FIG. 12. The engaging wall 20*c* restricts the movement of the crank 28. This prevents further movement of the rotor 26 in the locking direction e.

Figure 13:
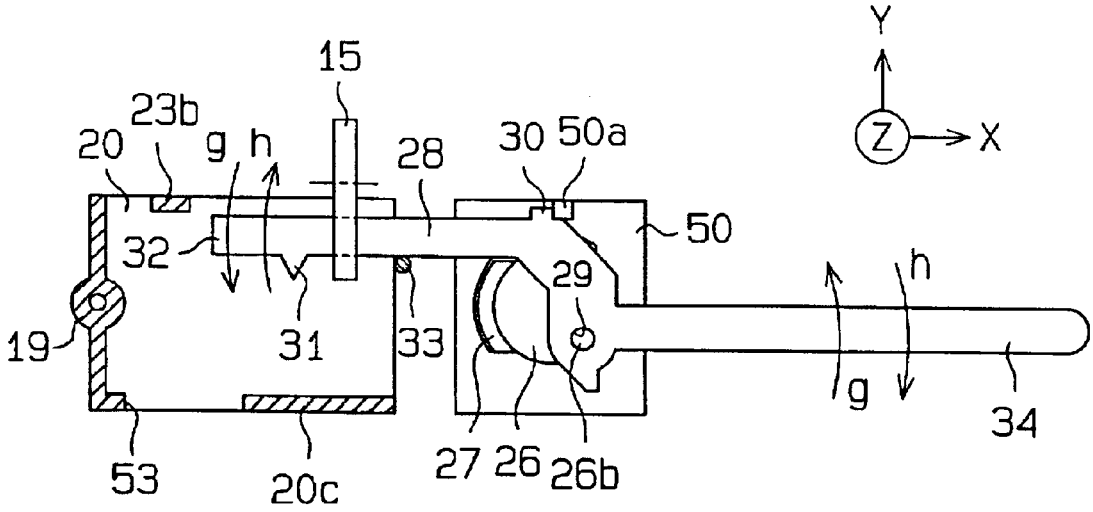
FIG. 13 is a schematic explanatory view showing the crank is located at a non-operational position.
Figure 14:
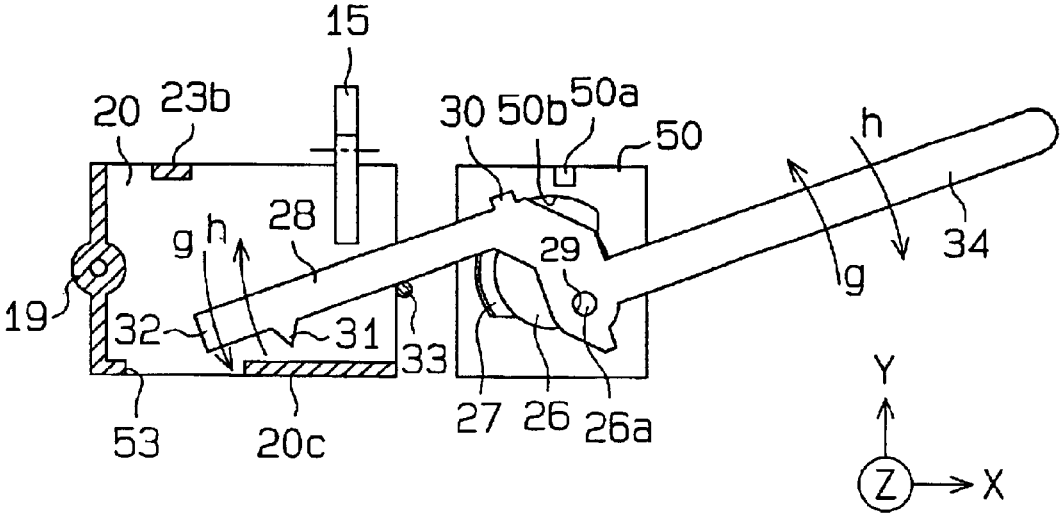
FIG. 14 is a schematic explanatory view showing the crank separated from the latch when the crank is located at the non-operational position.
Figure 15:
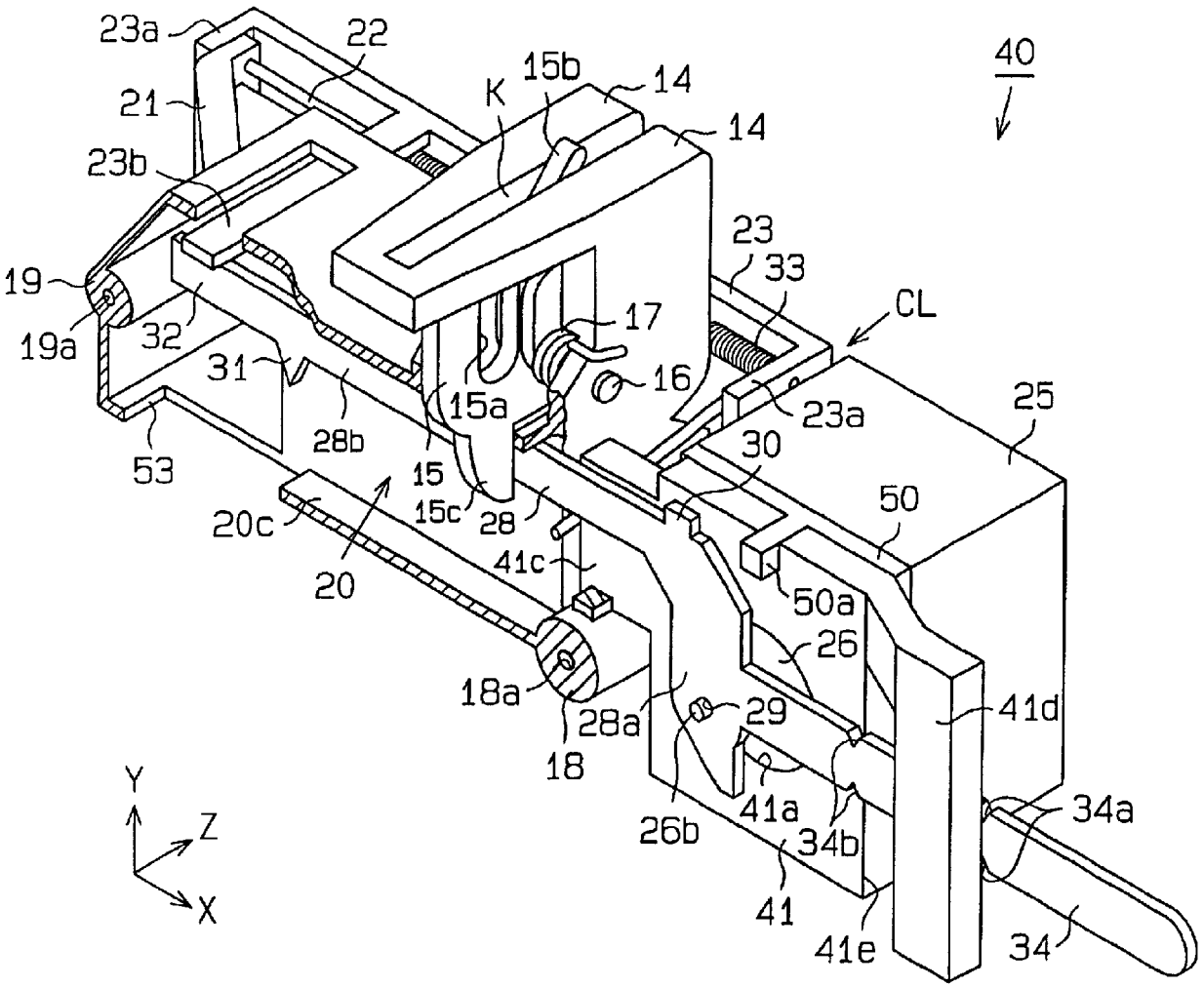
FIGS. 15 to 20 show a lock according to a second embodiment according to the present invention.
Figure 16:
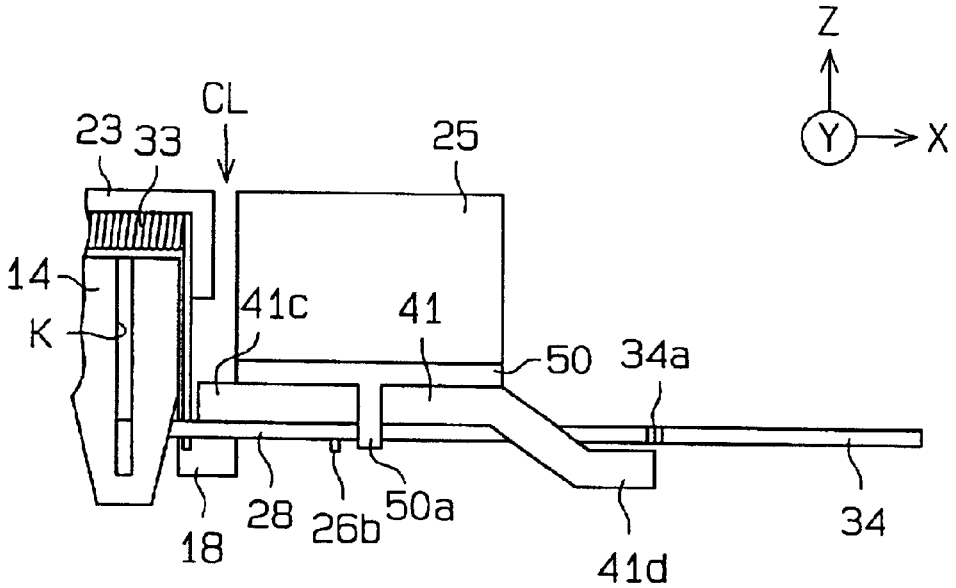

As shown in the state of FIG. 13, when the rotor 26 is located at the lock position, the pushed portion 32 is moved away from the pushing plate 23*b* in the X axis direction. In this state, the crank 28 is located at a non-operational position. When the crank 28 is located at the non-operational position, the abutment plate 30 of the crank 28 contacts the stopper 50*a*. Thus, further movement of the crank 28 from the non-operational position in the X axis direction is restricted.

Figure 4:
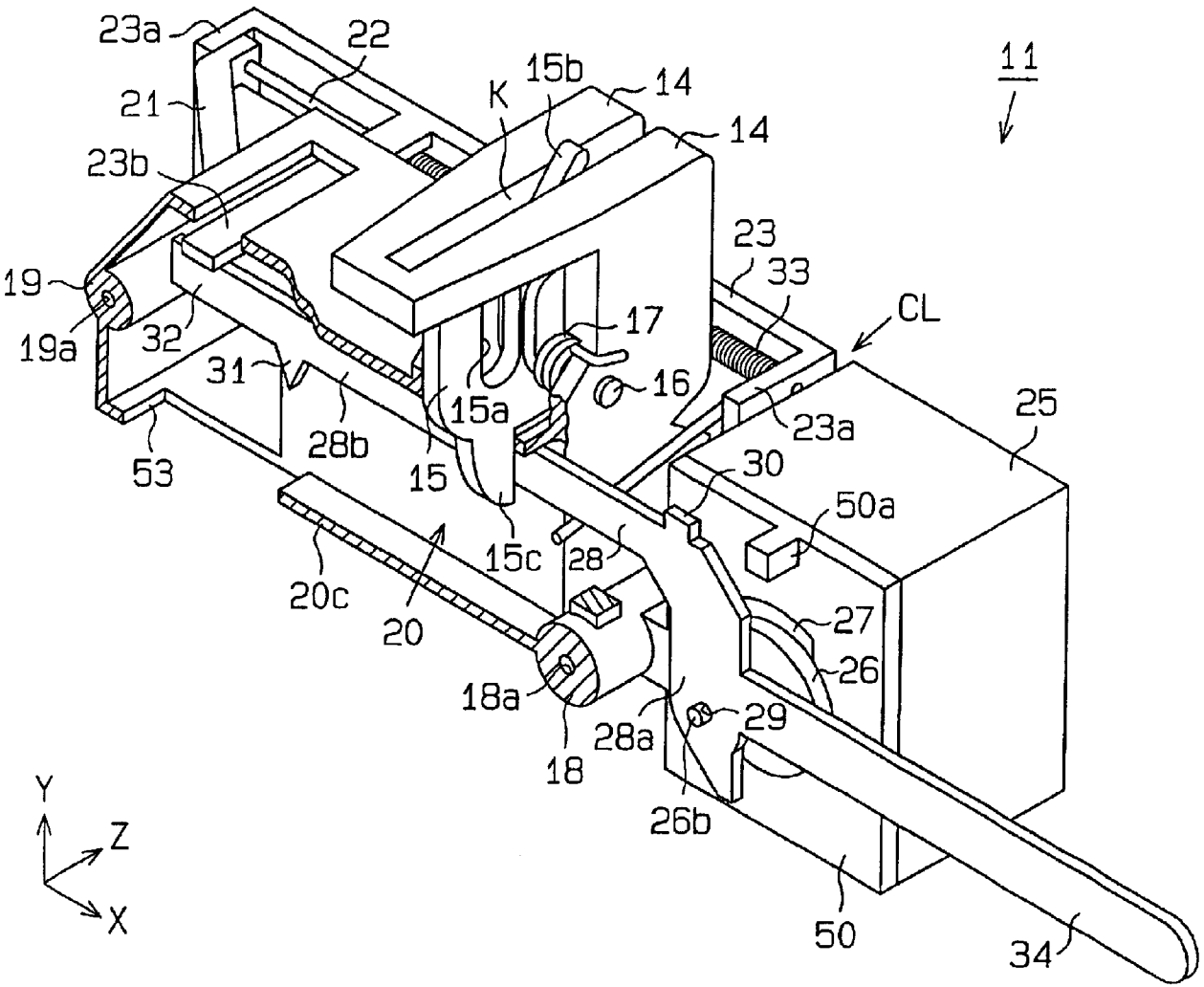
FIG. 4 is a partially cutaway perspective view showing the lock.

As shown in FIG. 8, a coil spring 33, which functions as a biasing member, is arranged on the shaft 22. One end of the coil spring 33 abuts the pushing plate 23*b* and constantly urges the handle 23 in the returning direction d. Referring to FIGS. 4, 11, and 12, the other end of the coil spring 33 contacts the elongated portion 28*b* and urges the crank 28 in the catching direction h. Regardless of whether the crank 28 is located at the operational or non-operational positions, the force of the coil springs 33, 17 abuts the engaging plate 15*c*, which is located at the engaging position, and a stepped part 15*d* of the basal portion of the engaging plate 15*c* against the elongated portion 28*b*.

Further, when the crank 28 (elongated portion 28*b*) moves in the negative Y axis direction regardless, of whether the crank 28 is located at the operational position or the non-operational position, the crank 28 is disengaged from the engaging plate 15*c* of the latch 15. The force of the coil spring 17 pivots the latch 15 in the releasing direction a and moves the latch 15 to the unlock position (FIG. 10).

A lever 34, which functions as a second manipulator, extends in the X axis direction from the short portion 28*a*. The lever 34 is manually manipulated from the inner side of the storage box 12 when the lid 12*b* is closed. The lever 34 and the crank 28 are integrally pivoted relative to the connecting rod 26*b*.

When the rotor 26 is in the unlocked state, the lid 12*b* is opened from the outer side of the storage box 12 in the manner described below.

In this state, the latch 15 is located at the engage position and the crank 28 is located at the operational position. Further, the pushing plate 23*b* of the handle 23 is in contact with the associated wall of the second frame portion 200.

Referring to FIG. 2, when the handle 23 is pivoted in the opening direction c, the pushing plate 23*b* of the handle 23 presses the pushed portion 32 of the crank 28 in the generally negative Y axis direction. The crank 28 moves in the releasing direction g away from the latch 15. The coil spring 17 moves the latch 15 from the engage position (FIG. 9) to the release position (FIG. 10). This separates the catch 13 from the engaging slot 15*a*. Thus, the lid 12*b* may be moved to open the box body 12*a*.

The opened lid 12*b* is closed as described below.

In this case, the latch 15 is located at the release position. The crank 28, which is biased by the coil spring 33, contacts the engaging plate 15*c* of the latch 15. The rotor 26 is located at the unlock position.

When the lid 12*b* is shut, the catch 13 of the storage box 12 contacts the hook 15*b* of the latch 15. This causes the catch 13 to push the latch 15 and pivot the latch 15 in the catching direction b about the pin 16 against the force of the coil spring 17. Thus, the catch 13 enters the engaging slot 15*a* (FIG. 9). The movement of the latch 15 to the engage position moves the engaging plate 15*c* out the moving path of the elongated portion 28*b*. Thus, the coil spring 33 moves the crank 28 in the catching direction h to the operational position (FIG. 11). The engaging plate 15*c* of the latch 15 then engages the elongated portion 28*b*. This arranges the elongated portion 28*b* at the engage position (FIG. 9).

When the rotor 26 is located in the locked state, the lid 12*b* cannot be opened from the outer side. The operation of the latch 15 in this state will now be discussed. In this state, the latch 15 is located at the engage position and the crank 28 is located at the non-operational position. The pushing plate 23*b* of the handle 23 engages the associated wall of the second frame portion 200.

As shown in FIG. 13, the pushed portion 32 of the crank 28 is separated from the pushing plate 23*b* of the handle 23 in the X axis direction. As a result, even if the handle 23 is rotated in the opening direction c, the pushing plate 23*b* does not push the pushed portion 32 of the crank 28. Accordingly, the lid 12*b* is not opened even if the handle 23 is manipulated.

The operation of the lock 11 when opening the lid 12*b* from the inner side of the storage box 12 regardless of whether the rotor 26 is located at the lock position or the unlock position will now be discussed. In such state, the latch 15 is located at the engage position regardless of whether the crank 28 is located at the operational position or the non-operational position.

As shown in FIG. 11, when the lever 34 is manipulated in the releasing direction g, the crank 28 is separated from the latch 15. This moves the latch 15 from the engage position (FIG. 9) to the disengage position (FIG. 10). As a result, the catch 13 is released from the engaging slot 15*a* and the lid 12*b* is opened.

With the above lock 11, a person locked in the storage box 12 may manipulate the lever 34 to unlock the lock 11 and open the lid 12*b*. Thus, when a person is in the storage box 12 in a state in which the lid 12*b* is shut and the lock 11 is locked, the person may open the lid 12*b* by himself.

A second embodiment according to the present invention will now be described with reference to FIGS. 15 to 20.

A lock 40 has a base 41, which is fixed to an attachment plate 50, to prevent manipulation from the outer side of the lock 40. The base 41 is located between the crank 28 and the attachment plate 50. A rotor 26 is inserted through a hole 41*a*, which extends through the central portion of the base 41. A stopper 50*a* extends through the base 41 from the attachment plate 50.

A guard 41*c*, which extends from the base 41, is arranged at a position corresponding to the clearance CL. The guard 41*c* blocks the elongated portion 28*b* of the crank 28 from the clearance CL such that the elongated portion 28*b* never opposes the clearance CL regardless of where the elongated portion 28*b* is located. Therefore, referring to FIGS. 15 and 16, the guard 41*c* prevents the crank 28 from being manipulated, for example, by a stick inserted in the clearance CL from the outer side of the lid 12*b*.

If there is no guard 41*c*, the crank 28 may be manipulated by inserting a stick in the clearance CL. This would result in the lid 12*b* being opened. However, the base 41 functions effectively to prevent the lid 12*b* from being opened from the outer side. This is extremely effective for security reasons.

Figure 18:
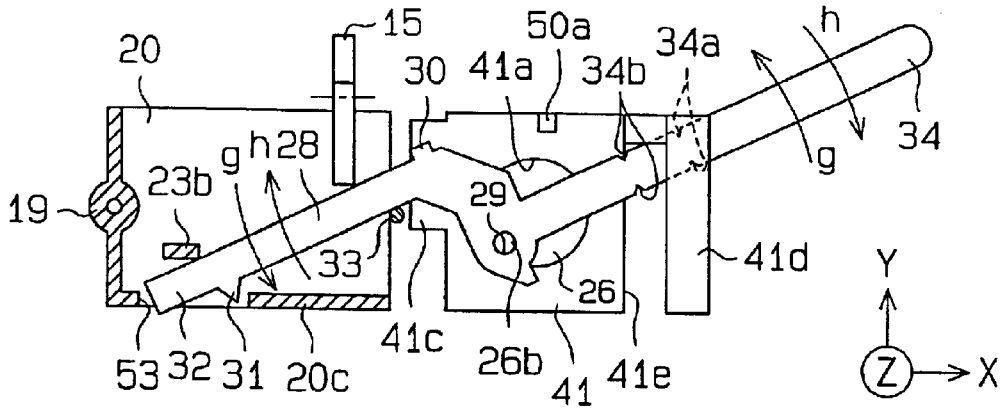
Figure 20:
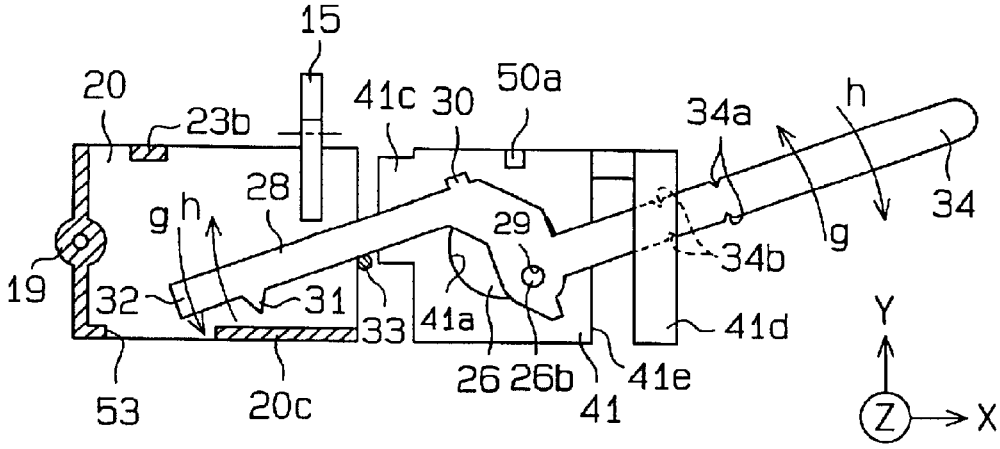

An engaging plate 41*d* extends from one side of the base 41. An opening 41*e* extends between the engaging plate 41*d* and the base 41. The engaging plate 41*d* is located farther from the attachment plate 50 than the base 41. The distal portion of the lever 34 extends through the opening 41*e* and further from the engaging plate 41*d*. Referring to FIGS. 18 and 20, the opening 41*e* is long enough to enable the pivoting of the crank 28.

A pair of opposing first notches 34*a* and a pair of opposing second notches 34*b* are formed on the lever 34. When the crank 28 is located at an operational position (FIG. 17), the first notches 34*a* are located at positions corresponding to the engaging plate 41*d*. When the crank 28 is located at a non-operational position (FIG. 19), the second notches 34*b* are located at positions corresponding to the engaging plate 41*d*.

Figure 17:
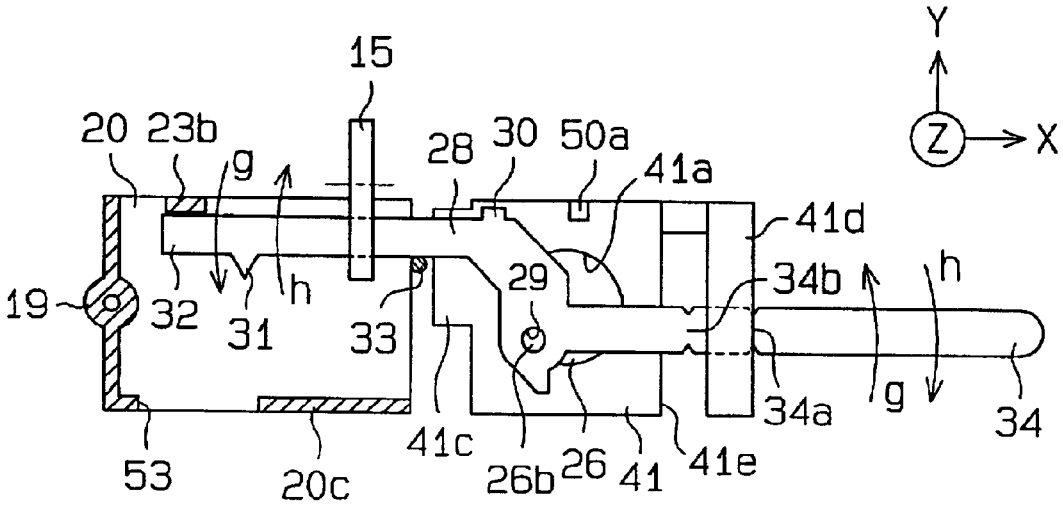
Figure 19:
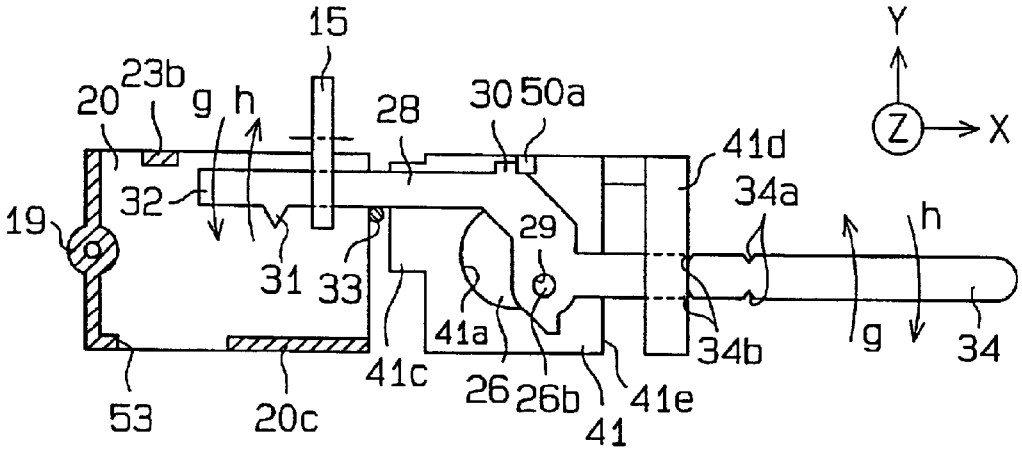

Referring to FIG. 17, when an excessive force is applied to the lever 34 in the negative Z axis direction, the lever 34 is pressed against the engaging plate 41*d* of the guard 41*c*. As a result, stress concentrates in the vicinity of the notches 34*a* and breaks the lever 34. Thus, parts other than the lever 34 that form the lock 40 are not damaged by the application of excessive force. Referring to FIG. 19, when the crank 28 is located at the non-operational position and the lever 34 is pressed against the engaging plate 41*d* of the base 41, stress concentrates on the vicinity of the second notches 34*b* and breaks the lever 34.

In the present invention, the lock 11 may be provided in the body 12*a* and the catch 13, which engages the latch 15, may be provided in the lid 12*b*.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A lock for a lid that selectively opens and closes a box, wherein one of the box and the lid is a first part and the other is a second part, the lock comprising:

a latch provided on the first part, wherein the latch engages a catch, which is on the second part, to prevent the lid from opening when the lid is closed;

a holding member, which moves between a locking position and an unlocking position, wherein the holding member engages the latch at the locking position and is disengaged from the latch at the unlocking position;

a first manipulator for opening the lid from an outer side of the box when the lid is closed, wherein the first manipulator moves the holding member from the locking position to the unlocking position;

a key lock mechanism, movable by an externally manipulated key, between an unlocked position and a locked position, and which shifts the holding member between an operational position, at which movement of the holding member by the first manipulator is enabled, and a non-operational position, at which movement of the holding member by the first manipulator is disabled;

a second manipulator for opening the lid from an inner side of the box when the lid is closed, wherein the second manipulator moves the holding member from the locking position to the unlocking position; and said second manipulator having a predetermined fragile portion that is broken due to excessive force applied to the second manipulator, such that when said second manipulator is broken, said key lock mechanism and said holding member remain operational.

2. The lock according to claim 1, further comprising a member concentrating the force in the predetermined fragile portion.

3. The lock according to claim 1, wherein said predetermined fragile portion includes a notch formed in the second manipulator.

* * * * *